United States Patent [19]

Kobayashi

[11] Patent Number: 4,877,925

[45] Date of Patent: Oct. 31, 1989

[54] MULTI-STAGE PUSH BUTTON SWITCH DEVICE

[75] Inventor: Shigetoshi Kobayashi, Tokyo, Japan

[73] Assignee: Clarion Co., Ltd., Tokyo, Japan

[21] Appl. No.: 260,380

[22] Filed: Oct. 20, 1988

[30] Foreign Application Priority Data

Oct. 23, 1987 [JP] Japan ..... 62-162401[U]
Oct. 23, 1987 [JP] Japan ..... 62-162403[U]

[51] Int. Cl.[4] ..... H01H 13/70
[52] U.S. Cl. ..... 200/5 A; 200/343
[58] Field of Search ..... 84/432–436, 84/452; 400/472, 473, 480, 481, 488, 489, 491.2; 200/5 R, 5 A, 329, 331, 332, 335, 340; 235/145 R

[56] References Cited

U.S. PATENT DOCUMENTS

| | | | |
|---|---|---|---|
| 3,205,754 | 9/1965 | Becwar | 84/433 |
| 3,941,023 | 3/1976 | Thomas et al. | 84/433 X |
| 4,136,270 | 1/1979 | Wernet et al. | 200/335 X |
| 4,315,114 | 2/1982 | Monti, Jr. | 200/340 X |

*Primary Examiner*—J. R. Scott

*Attorney, Agent, or Firm*—Flynn, Thiel, Boutell & Tanis

[57] ABSTRACT

A multi-stage push button switch device includes a plurality of first and second push button members fixedly coupled to a base plate. Each first and second push button member includes a button portion having a flexible arm portion extending therefrom. The end of each flexible arm portion remote from the button portion is coupled to the base plate. The flexible arm portions of the second push button members are longer than the flexible arm portions of the first push button members, whereby the button portions of the second push button members are supported at a greater distance from the base plate than the button portions of the first push button members. The first and second push button members have working pieces protruding therefrom and movable in response to a pushing of the associated button portion to push and thereby actuate an associated switch. The switches are disposed relative to the push button members such that those switches associated with the second push button members are at a distance therefrom greater than the distance between the first push button members and the switches associated therewith.

20 Claims, 2 Drawing Sheets

MULTI-STAGE PUSH BUTTON SWITCH DEVICE

FIELD OF THE INVENTION

This invention relates to a push button device used in the operating portion of various sorts of electronic devices, etc. and more in detail to a push button device in which a plurality of push button portions are coupled with a base portion through flexible arms and when one of the push button portions is pushed to be operated, a working piece protruding from the rear side thereof is moved in a direction approximately perpendicular to the direction of the pushing operation to drive a push switch.

BACKGROUND OF THE INVENTION

There are known various types of push button devices used in the operating portion of various sorts of electronic devices, etc., in one of which a plurality of buttons are coupled with a base plate through flexible arms.

An example of this type of push button devices is indicated in FIG. 6A. A flexible arm 70 is coupled with a base portion 74 at its lower extremity. At the head portion of the flexible arm 70, a button 71 is formed in one body therewith. A working piece 72 mounted on the flexible arm 70 on its rear side between the button 71 and the base portion 74 extends approximately in the horizontal direction. When the button is pushed, the flexible arm 70 is bent so that the working piece 72 is moved in a direction approximately perpendicular to the direction of the push of the button 71 and pushes a switch 75 on the base plate 76 to drive it.

The push button device having this construction has an advantage that the number of parts and the number of mounting steps can be reduced, because it is not necessary to arrange switches which are turned on and off by working pieces in the direction parallel to the push button device and the switches can be mounted directly on the circuit base plate owing to the fact that the direction of the push of the button and the operation direction of the working piece form an angle of about 90°.

On the other hand, the number of functions of electronic devices are represented by e.g. audio devices has increased remarkably and there is a tendency that the number of operation buttons increases also in keeping therewith. In many cases, this increased number of operation buttons are arranged in a plurality of stages taking the size of the front panel of the devices and the operability thereof into account. However, when it is tried to realize arrangement of the plurality of stages of buttons in a push button device having the structure described above, several difficulties are confronted.

Firstly, in the case where the push button device has the structure using a flexible arm, there is a drawback that the amount of push for driving the working piece is different for the upper stage (second stage) and the lower stage if the flexible arm for the push buttons in the upper stage is longer in order to arrange them in plural stages. That is, as indicated in FIG. 5 (in the figure, for the sake of simplifying the explanation, only one is indicated for all the flexible arms 62) in order to move the working piece 63 so as to be inclined by the amount indicated in the figure, for a push button of the lower stage for which the flexible arm 62 is short, it is sufficient to push it over a range of P2 while for a push button of the upper stage for which the flexible arm 60 is long, it is necessary to push it over a range of P1. For this reason, if the push buttons are simply arranged in plural stages, the amount of push is different for the push buttons in the upper and the lower stages which gives rise to a drawback that the operability is bad.

Secondly, the flexible arms supporting the push buttons in the upper stages are necessarily longer than the flexible arms supporting the push buttons in the lower stage. Consequently, the working pieces do not protrude from the rear side of the buttons, but they protrude from the rear side of the flexible arms.

Then, since the part $\alpha$ (FIG. 6B) of the flexible arm between the button 71 and the working piece 72 is also bent by the pushing operation, the most part of the amount of push of the button 71 is absorbed by this part and therefore, unless the button is pushed over a large range, the working piece 72 is not satisfactorily pushed down which gives rise similarly to a drawback that the operability is worsened.

The inventors of this invention know at this time no push button devices of this type having this 2-stage structure. Consequently, they believe that it is not suitable to call the two drawbacks described above "drawbacks of the prior art techniques". However, these drawbacks have been described in the item of the "BACKGROUND OF THE INVENTION", because these are problematical points which they have encountered in the course through which they have reached this invention and indispensable as a premise for explaining the effect of the invention.

OBJECT OF THE INVENTION

The object of the invention is to provide a multi-stage push button device capable of removing the inconveniences described above taking place at forming push buttons in the push button device in plural stages.

SUMMARY OF THE INVENTION

A first feature of this invention consists in that switches corresponding to buttons of the second stage supported by long flexible arms are located behind switches corresponding to buttons of the first stage supported by short flexible arms. A second feature of this invention consists in that bending of the part between the button and the working piece in each of the longer flexible arms of the second stage is regulated.

DETAILED DESCRIPTION

Figure 1:
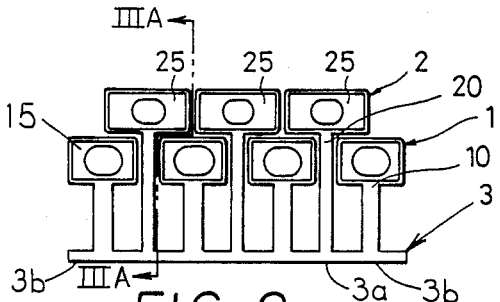
FIG. 1 is a front view illustrating an embodiment of the multi-stage push button device according to this invention.
Figure 2:
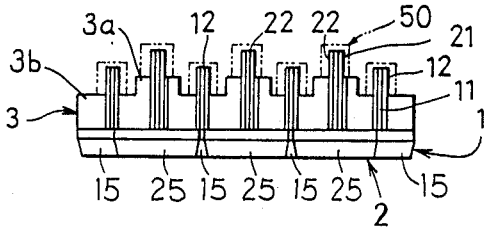
FIG. 2 is a top view of the embodiment indicated in FIG. 1.

In FIG. 1, four push buttons 1 are located adjacent to each other in the horizontal direction in a first stage and three push buttons 2 are located adjacent to each other in the horizontal direction in a second stage thereabove. These push buttons 1 and 2 include flexible arms 10 and 20 as well as buttons 15 and 25, respectively and they are secured to an end portion of a base plate 3 through the flexible arms 10 and 20, respectively in one body. As evident from FIGS. 2 and 3, the flexible arms 10 and 20 are respectively integrally connected to portions 3*b* and 3*a* of the base plate 3, and the portions 3*a* are longer than the portions 3*b*. The flexible arms 10 and 20 are made of synthetic resin in the form of thin plates. Owing to the substance and the form of thin plates, they can be bent before and behind (behind in FIG. 1). The buttons 15 and 25 are so constructed that they can be pushed-in owing to the flexibility of the flexible arms 10 and 20. The push buttons 1 of the first stage are located with a predetermined gap and each of the flexible arms 20 is disposed at this gap. The buttons 15 and 25 as well as the flexible arms 10 and 20 are so located that they are not superposed on each other, viewed from the front as indicated in FIG. 1. Owing to this structure it is possible to form them in one body by the injection molding using synthetic resin.

Figure 3B:
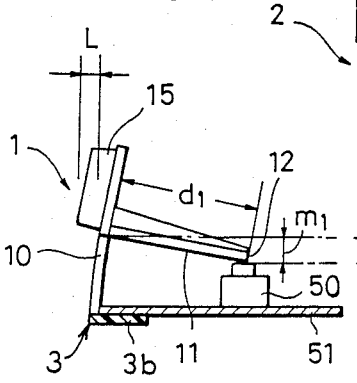
FIG. 3B is a sectional view generally similar to FIG. 3A, but showing a different part of the inventive device.
Figure 3A:
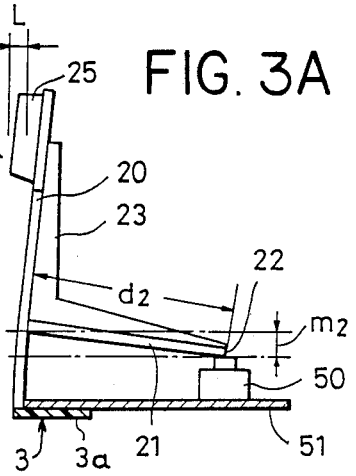
FIG. 3A is a sectional view taken along the line IIIA—IIIA in FIG. 1.

On the rear side of the push buttons 1 and 2 are mounted in one body working pieces 11 and 21, respectively. The working pieces 11 and 21 are mounted on the push buttons 1 and 2, respectively so as to extend in the horizontal direction so that they are perpendicular to each other. Each of the working pieces 11 is disposed on the rear side of a button 15 as indicated in FIG. 3, and each of the working pieces 21 is disposed on the rear side of the middle portion of a flexible arm 20. This is due to fact that there is a difference in the length between the flexible arms 10 and 20, and the working pieces 11 and 21 are located at a same height from the base plate 3. Working points 12 and 22 are disposed at predetermined positions of the working pieces 11 and 21 in this embodiment at the extremities of the working pieces 11 and 21, respectively. There is disposed a switch 50 which is the object to be driven, below each of the working points. As evident from FIG. 3, the switches 50 and the base plate 3 are preferably supported on a support plate or bracket 51 which is secured to base plate 3. The positions of the working points 12 and 22 are determined corresponding to the length of the flexible arms 20. That is, the distance d1 from the inner surface of the flexible arm 10 to the working point 12 is smaller than the distance d2 from the inner surface of the flexible arm 20 to the working point 22. The positions of the working points 12 and 22 are so regulated that the amounts of displacement m1 and m2 of the working points 12 and 22 are equal to each other for a same amount of push L of the buttons 15 and 25. Concretely speaking, the ratio of the length of the flexible arm 10 to the distance d1 is approximately equal to the ratio of the length of the flexible arm 20 to the distance d2 and the working positions 12 and 22 may be determined by taking into account the amounts of displacement thereof in the vertical direction when the buttons 15 and 25 are pushed-in.

The positions of the working points 12 and 22 are not restricted to the extremities of the working pieces 11 and 21, but they may be located at any point in the middle portion thereof. Consequently, it is also possible to vary only the positions of the working points 12 and 22, the working pieces 11 and 21 having a same length.

In the above embodiment when the push buttons 1 and 2 are pushed-in owing to the flexibility of the flexible arms 10 and 20, the working points 12 and 22 move downward to drive the respective switches 50. At this time, since the amount of push is same and L for both the buttons, it is possible to operate the push buttons 1 and 2 with a same completely identical feeling. In this way, the operation of the push buttons gives no feeling of disorder for the first and the second stages and thus the operability is remarkably improved.

In a second embodiment, there is disposed a bending regulating portion on the push button 2. This bending regulating portion is constituted by an L-shaped bending regulating plate 23 extending from the rear surface of the flexible arm 20 to the upper surface of the working piece 21. It is a matter of course that this bending regulating plate 23 is made of synthetic resin in one body together with the push buttons 1, 2, the flexible arms 10, 20 and the base plate 3.

Figure 6A:
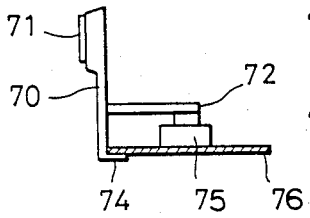
FIGS. 6A and 6B illustrate the bending of the flexible arms which is the other of the problematical points with which the present invention is concerned.
Figure 6B:
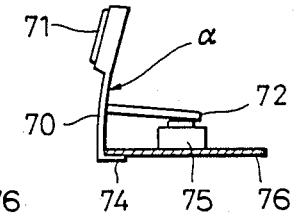

Since the bending of the part of the flexible arm 20 above the working piece 21 is prevented by the bending regulating portion, the amount of push of the button 25 is not absorbed by this part as indicated in FIG. 6.

Figure 4:
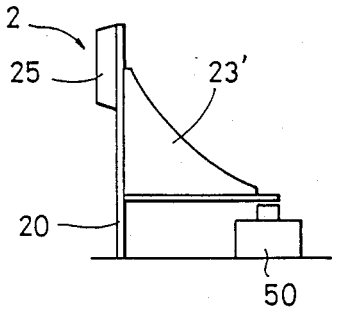
FIG. 4 is a side view of another embodiment of this invention.
Figure 5:
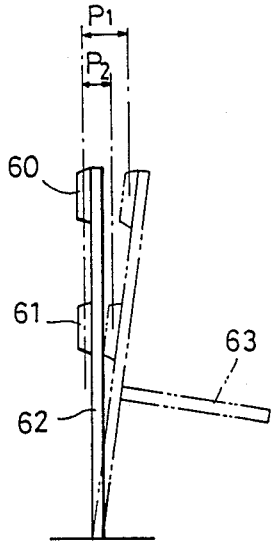
FIG. 5 illustrates the operation in the amount of push between push buttons of the upper and the lower stages which is one of the problematical points with which the present invention is concerned.

The shape of the bending regulating plate 23 is not restricted to the L shape, but a triangular bending regulating plate 23', etc. may be adopted as well, as indicated in FIG. 4. Thus any bending regulating means may be used if it can hold fixedly the flexible arm 20 and the working piece 21.

What is claimed is:

1. A multi-stage push button switch device comprising:

a base portion;

a plurality of first push button members, each of which includes a first button portion and a first flexible arm portion extending from said first button portion approximately in a first direction, one end of each said first flexible arm portion remote from the first button portion being fixedly coupled to said base portion;

a plurality of second push button members, each of which includes a second button portion and a second flexible arm portion extending from said second button portion approximately in said first direction, one end of each said second flexible arm portion remote from the second button portion being fixedly coupled to said base portion, said second flexible arm portions being longer than said first flexible arm portions;

a plurality of first push switches and means for supporting each said first push switch stationarily with respect to said base portion at a location spaced in a second direction approximately perpendicular to said first direction from a respective one of said first push button members;

a plurality of second push switches and means for supporting each said second push switch stationarily with respect to said base portion at a location spaced in said second direction from a respective one of said second push button members, the distance between each said second push switch and the second flexible arm portion of the corresponding second push button member being greater than the distance between each said first push switch and the first flexible arm portion of the corresponding first push button member;

a first working piece projecting approximately in said second direction from each of said first push button members, each of said first working pieces having a portion which is spaced from the corresponding first flexible arm portion and which, when the corresponding button portion is manually pushed in approximately said second direction, is moved approximately in said first direction and engages and actuates a respective said first push switch; and a second working piece projecting approximately in said second direction from each of said second push button members, each of said second working pieces having a portion which is spaced from the corresponding second flexible arm portion and which, when the corresponding button portion is manually pushed approximately in said second direction, is moved approximately in said first direction and engages and actuates a respective said second push switch.

2. A multi-stage push button switch device according to claim 1, wherein said first push button members, said first working pieces, said second push button members, said second working pieces and said base portion are integral portions of a single part made of synthetic resin.

3. A multi-stage push button switch device according to claim 1, wherein adjacent said first push button members are spaced from each other, and wherein a respective one of said second flexible arm portions extends between each adjacent pair of said spaced first push button members.

4. A multi-stage push button switch device comprising:

a base portion;

a plurality of first push button members, each of which includes a first button portion and a first flexible arm portion extending from said first button portion approximately in a first direction, one end of each said first flexible arm portion remote from the first button portion being fixedly coupled to said base portion;

a plurality of second push button members, each of which includes a second button portion and a second flexible arm portion extending from said second button portion approximately in said first direction, one end of each said second flexible arm portion remote from the second button portion being fixedly coupled to said base portion, said second flexible arm portions being longer than said first flexible arm portions;

a plurality of first push switches and means for supporting each said first push switch stationarily with respect to said base portion at a location spaced in a second direction approximately perpendicular to said first direction from a respective one of said first push button members;

a plurality of second push switches and means for supporting each said second push switch stationarily with respect to said base portion at a location spaced in said second direction from a respective one of said second push button members, the distance between each said second push switch and the second flexible arm portion of the corresponding second push button member being greater than the distance between each said first push switch and the first flexible arm portion of the corresponding first push button member;

a first working piece projecting approximately in said second direction from each of said first push button members, each of said first working pieces having a portion which is spaced from the corresponding first flexible arm portion and which, when the corresponding button portion is manually pushed approximately in said second direction, is moved approximately in said first direction and engages and actuates a respective said first push switch;

a second working piece projecting approximately in said second direction from each of said second push button members, each of said second working pieces having a portion which is spaced from the corresponding second flexible arm portion and which, when the corresponding button portion is manually pushed approximately in said second direction, is moved approximately in said first direction and engages and actuates a respective said second push switch; and a bending regulating portion extending from a side surface of each of said second push button members facing approximately in said second direction to said second working piece thereon and resisting bending of a part of said second push button member between said second button portion thereof and said second working piece thereon.

5. A multi-stage push button switch device according to claim 4, wherein said first push button members, said first working pieces, said second push button members, said second working pieces, said bending regulating portions and said base portion are integral portions of a single part made of synthetic resin.

6. A multi-stage push button switch device according to claim 5, wherein each said bending regulating portion is substantially L-shaped, having two legs respectively extending along and connected to the corresponding second flexible arm portion and the corresponding second working piece.

7. A multi-stage push button switch device according to claim 5, wherein each said bending regulating portion is connected to the corresponding second button portion and to said portion of the corresponding second working piece.

8. A multi-stage push button switch device according to claim 7, wherein said bending regulating portions have a substantially right triangular shape, said bending regulating portions each having one edge extending along and connected to the corresponding second flexible arm portion and another edge extending along and connected to the corresponding second working piece.

9. A multi-stage push button switch device according to claim 1, wherein said portions of said first working pieces each engage and actuate a respective said first switch when the corresponding first button portion is manually moved a threshold distance in said second direction, and wherein said portions of said second working pieces each engage and actuate a respective said second push switch when the corresponding second button portion is manually moved said threshold distance in said second direction.

10. A multi-stage push button switch device according to claim 9, wherein a first ratio of the distance between each said first push switch and the corresponding first flexible arm portion to the length of the corresponding first flexible arm portion is approximately equal to a second ratio of the distance between each said second push switch and the corresponding second flexible arm portion to the length of the corresponding second flexible arm portion.

11. A multi-stage push button switch device according to claim 10, wherein said portions of said first working pieces are each moved a displacement distance in said first direction when the corresponding first button portion is manually moved said threshold distance in said second direction, and wherein said portions of said second working pieces are each moved said displacement distance in said first direction when the corresponding second button portion is manually moved said threshold distance in said second direction.

12. A multi-stage push button switch device according to claim 11, wherein said first and second working pieces are substantially equidistant from said base portion in a direction opposite said first direction.

13. A multi-stage push button switch device according to claim 12, wherein said second working pieces project from said second flexible arm portions of said second push button members.

14. A multi-stage push button switch device according to claim 13, wherein said first and second flexible arm portions of said first and second push button members are disposed substantially in a common plane, said first and second flexible arm portions being sequentially alternatingly positioned in spaced relationship along said base portion.

15. A multi-stage push button switch device according to claim 14, wherein said first and second button portions have portions which project beyond said flexible arm portions in a direction substantially opposite said second direction.

16. A multi-stage push button switch device according to claim 15, wherein said first button portions each have a width in a third direction perpendicular to said first and second directions which is slightly less than the distance between adjacent said second flexible arm portions, and wherein said second button portions each have a width in said third direction which is slightly greater than the distance between adjacent said first flexible arm portions.

17. A multi-stage push button switch device according to claim 16, wherein each said flexible arm portion has a width in said third direction which is substantially less than the width in said third direction of the corresponding button portion, wherein said first flexible arm portions have a larger said width than said second flexible arm portions, and wherein said base portion is coupled to said first and second push button members so as to extend therefrom substantially in said second direction.

18. A multi-stage push button switch device according to claim 17, wherein each said flexible arm portion extends from a location on the corresponding button portion which is centered relative to the width in said third direction of the button portion.

19. A multi-stage push button switch device according to claim 18, wherein said first working pieces project from said first button portions of said first push button members.

20. A multi-stage push button switch device according to claim 1, wherein said means for supporting said first push switches and said means for supporting said second push switches includes a support plate secured to said base portion and projecting therefrom approximately in said second direction, said first and second push switches being provided on said support plate.

* * * * *